United States Patent [19]

Kataoka

[11] 4,150,797

[45] Apr. 24, 1979

[54] METHOD AND DEVICE FOR CONTROLLING CONTACT PRESSURE ON TOUCH ROLLER IN SHEET WINDER

[76] Inventor: Hiroshi Kataoka, 5-8, Asahi 1-chome, Iyomishima-shi, Ehime-ken, Japan

[21] Appl. No.: 905,463

[22] Filed: May 12, 1978

Related U.S. Application Data

[63] Continuation-in-part of Ser. No. 609,907, Sep. 3, 1975, abandoned.

[30] Foreign Application Priority Data

Aug. 8, 1975 [JP] Japan ..... 50/95743

[51] Int. Cl.[2] ..... B65H 17/02; B65H 23/00

[52] U.S. Cl. ..... 242/67.1 R; 242/75.2

[58] Field of Search ..... 242/67.1 R, 67.2, 67.3 R, 242/67.4, 67.5, 65, 66, 75.1, 75.2

[56] References Cited

U.S. PATENT DOCUMENTS

| | | | |
|---|---|---|---|
| 2,872,126 | 2/1959 | Rockstrom et al. | 242/65 |
| 3,599,889 | 8/1971 | Pfeiffer | 242/66 |
| 3,604,649 | 9/1971 | Dorfel | 242/66 |
| 3,670,980 | 6/1972 | Mukai et al. | 242/75.2 X |
| 3,687,388 | 8/1972 | Pfeiffer | 242/65 |
| 3,844,502 | 10/1974 | Toy | 242/67.1 R |
| 3,977,619 | 8/1976 | Nagata et al. | 242/75.2 X |

*Primary Examiner*—Harvey C. Hornsby
*Assistant Examiner*—John M. Jillions
*Attorney, Agent, or Firm*—Oblon, Fisher, Spivak, McClelland & Maier

[57] ABSTRACT

In a sheet winder for winding sheet material into rolls while holding the sheet roll in contact with a touch roller, the contact pressure between the sheet roll and the touch roll is maintained constantly at the optimum magnitude by a method which comprises determining the uncompensated contact pressure owing to the weight of the sheet roll and the rocking arm on which the sheet roll is supported, comparing the uncompensated contact pressure with an optimum contact pressure predetermined on the basis of various properties of the material of the sheet being wound and adjusting the actual contact pressure to the optimum contact pressure.

2 Claims, 11 Drawing Figures

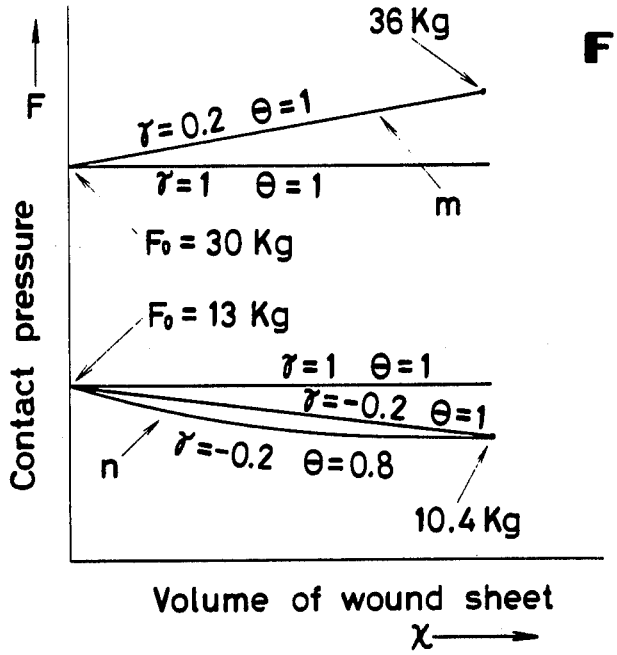
Fig. 6
Fig. 7 (a)
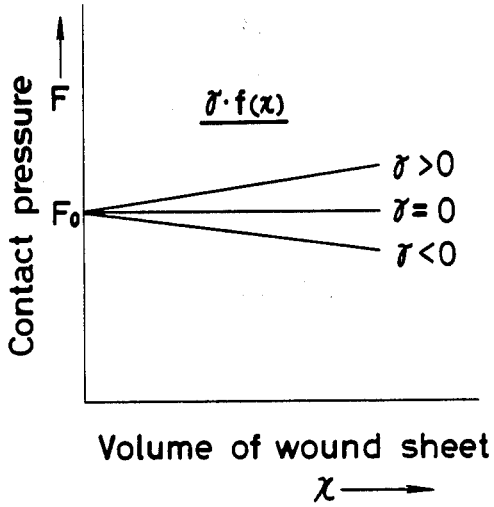
Fig. 7 (b)
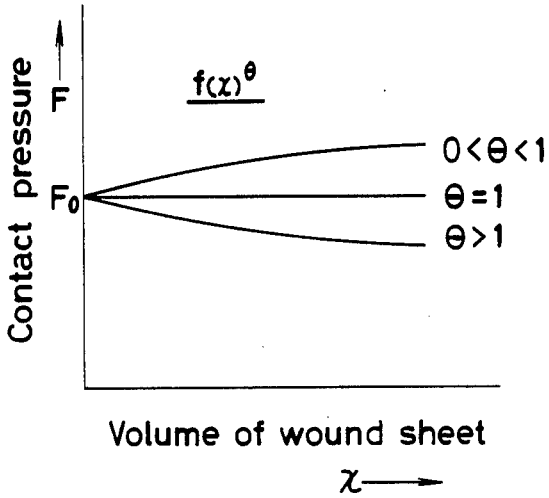

METHOD AND DEVICE FOR CONTROLLING CONTACT PRESSURE ON TOUCH ROLLER IN SHEET WINDER

REFERENCE TO COPENDING APPLICATION

This is a continuation-in-part application of my copending application U.S. Ser. No. 609,907 filed Sept. 3, 1975, now abandoned.

BACKGROUND OF THE INVENTION

This invention relates to a method and device for providing a sheet winder of the type using a touch roller with automatic control which enables the contact pressure of sheet roll upon the touch roller, a parameter that determines the quality of sheet rolls produced, to be constantly maintained at the optimum magnitude.

In the production of rolled sheets of various materials such as paper, synthetic resins and cloths, there is acutely felt the need for a sheet winder capable of minimizing the unavoidable deformation and dimensional change of the sheet material which occurs in sheet winding and of permitting production of quality sheet rolls the sheet material of which retains the properties which it is intended to possess. One of the existing sheet winders claimed to be capable of producing sheet rolls of high quality has a means called a touch roller with which the roll is held in contact immediately behind the point of contact between the sheet being wound and the underlying roll. This touch roller serves to press the sheet against the rotating roll so as to force out any air entrapped between the sheet and the surface of the underlying roll for the purpose of obtaining a sheet roll having the sheet wound up to the density most suited to the particular material of the sheet. The touch roller which concurrently serves as a guide for the sheet is usually set in such a position that the sheet roll being formed rides on the upper part of the touch roller. Owing to this contact, the touch roller rotates at the same peripheral speed as the sheet roll while the sheet is being wound round the sheet roll. The core of the sheet roll moves away from the touch roller as the winding of the sheet progresses and the sheet roll grows gradually in diameter. If this process is left to proceed freely, the contact pressure of the sheet roll upon the touch roller will depend solely on the weights of the roll and the rocking arm on which it is supported and will increase in proportion to the amount of the sheet wound in the sheet roll. Consequently, the contact pressure near the end of the winding operation will be vastly different from the contact pressure at the start of the sheet winding. This method, therefore, is incapable of providing the optimum contact pressure throughout the winding operation and is therefore unsuitable for the winding of sheet material and is particularly unsuitable for winding thin sheet material which is apt to elongate.

An improved sheet winding method is known in which a force is applied to the sheet roll in the direction serving to raise it from the touch roller. This method effects automatic control of the contact pressure by detecting the radius of the sheet roll as an indication of the amount of sheet wound thereon, determining the desirable contact pressure for the amount of wound sheet detected on the basis of empirical data and, applying a force to the arm supporting the sheet roll to raise the sheet roll away from the touch roller to the degree required to obtain the optimum contact pressure between the sheet roll and the touch roller. Although this method has proved satisfactory in the winding of thick sheet material which does not easily elongate under tension, it fails to provide the precise control required for the winding of a sheet of thin material which is easily deformed. In this method, the amount of sheet already wound up is determined from the radius of the wound sheet roll which is in turn determined from the distance between the axis of the touch roller and the axis of the sheet roll. Since the contact pressure between the touch roller and the sheet roll causes a depression in the surface of the sheet roll, the distance between these axes does not faithfully reflect the radius of the wound sheet roll so that an error is introduced in the determination of the optimum contact pressure. Even if this disadvantage should be eliminated somehow, there still remains the fact that the characteristics of the optimum contact pressure have never been established with due consideration to the properties of the particular material of the sheet to be wound up. Thus, this method can hardly be expected to provide definitely reliable control of the sheet winding.

The need for a method capable of producing rolled sheets of high quality is felt in various industries. In searching for a way to meet this need, the inventor took particular interest in the immense effect produced on the quality of finished sheet rolls by the contact pressure between the sheet roll and the touch roll and, through systematic analysis of a huge volume of technical data which he collected, determined the optimum contact pressure for sheet materials having various properties and succeeded in developing a sheet winding method making effective use of the determined optimum contact pressures (Japanese Patent Public Disclosure No. 50549/1975, Patent Publication No. 44999/1977 dated Nov. 11, 1977).

The quality of a sheet roll hinges upon the winding density which in turn is affected by the tension applied to the sheet in the course of the winding. The sheet being wound is distorted or stretched when this winding density is higher than is normally required. When the winding density is too low, the sheet suffers from the "air table" phenomenon in which the sheet slips on the surface of the roll, the sheet edges fall out of alignment or the sheet roll sustains winding squeeze.

With a view to eliminating these defects, the inventor conducted an elaborate study on the properties of sheet material and, beginning from the basic principle that a comparatively thick sheet (such as of thick paper) which does not easily elongate and which has a nonslippery surface should be wound rather tightly (with high winding density) and a comparatively thin sheet (such as of synthetic resin film) which elongates easily and has a slippery surface should be wound rather loosely (with low winding density), he established optimum winding conditions for various sheet materials and developed the method for controlling the contact pressure on the touch roller as described above. In this method the radius of the sheet roll is continuously monitored by a measuring arm so ligth as to make substantially no depression in the sheet roll. Thus, with a means for accurately determining the amount of sheet wound on the roll and by controlling the contact pressure to the optimum contact pressure determined as described above, this previously developed method made it possible to produce sheet rolls of high quality.

Despite the advantages described, this method has one weak point in that it cannot be applied in unmodified form to conventional sheet winders and the construction of the device used for the operation of this method tends to become rather complicated.

SUMMARY OF THE INVENTION

It is, therefore, an object of the present invention is to provide a method for automatically controlling the contact pressure between the sheet roll and the touch roller to the optimum level on the basis of the amount of sheet wound on the sheet roll and the optimum winding conditions for the particular material of the sheet to be wound.

Another object of the present invention is to provide a device for carrying out such a method which can be easily applied to the conventional sheet winder.

The method of the present invention for the control of the contact pressure between the sheet roll and the touch roller comprises determing the uncompensated contact pressure which would bear upon the touch roller owing to the weights of the sheet roll and the rocking arm supporting the sheet roll if no adjustment of contact pressure were made, comparing the uncompensated contact pressure with the optimum contact pressure determined from the properties of the particular material of the sheet being wound into the sheet roll, and adjusting the actual contact pressure to the optimum contact pressure.

The comparison of the uncompensated contact pressure due to the weights of the sheet roll and the rocking arm with the predetermined optimum contact pressure enables the winding of sheet to be performed with the contact pressure maintained constantly at the level most suited to the particular material of the sheet in use. The invention is applicable to any conventional sheet winder of the type using a touch roller and enables the work of sheet winding which has heretofore relied soley upon skill and experience on the part of operators to be controlled automatically.

BRIEF EXPLANATION OF THE DRAWING

FIG. 6 is a graph representing the characteristic of the optimum contact pressure of the sheet roll upon the touch roller.

FIGS. 7(*a*) and 7(*b*) are graphs representing varying characteristics of desirable contact pressure.

DETAILED DESCRIPTION OF THE INVENTION

Figure 1:
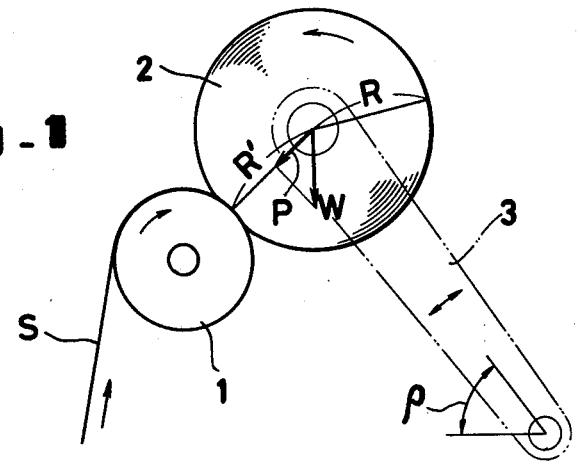
FIG. 1 is an explanatory diagram showing the relationship between the sheet roll and the touch roller during the operation of sheet winding.

Generally in the shaft drive type sheet winder, a stationary touch roller 1 is disposed near the point where sheet S winds onto a sheet roll 2 as illustrated in FIG. 1 and the sheet roll 2 rests in contact with the touch toller so as to receive the contact pressure necessary for proper sheet winding. When the contact pressure is left uncontrolled, the component P in the direction of the touch roller 1 of the weight W of the sheet roll 2 becomes the contact pressure. In controlling the contact pressure it is necessary to know the weight of the sheet roll 2 at all stages of winding. Generally, the total weight of the sheet roll 2 is estimated from the radius of the sheet roll which is calculated from the angle of rotation $\rho$ of a rocking arm 3 supporting the sheet roll 2. However, the radius determined by the method is not the real radius R but an apparent radius R′ because the surface of the sheet roll is depressed by the touch roller 1. Thus, the radius determined from the angle of rotation of the rocking arm 3 contains an error equivalent to the difference (R-R′). This error may have a major adverse effect on the quality of the finished sheet roll particularly when the sheet material is thin and easily deformed.

Figure 2:
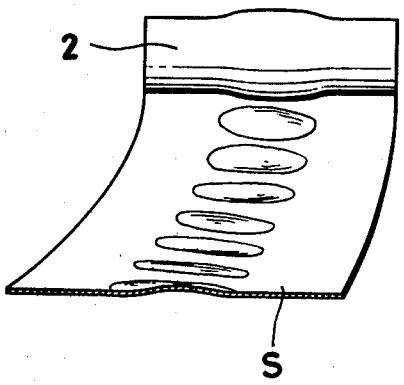
FIGS. 2 and 3 are explanatory diagrams showing the effects of improper winding operations upon sheets.
Figure 3:
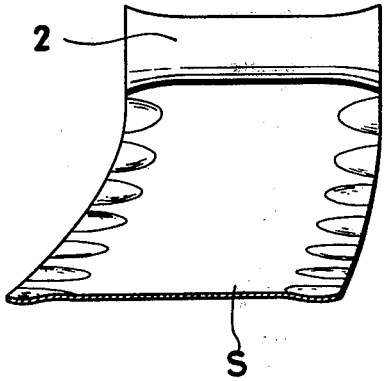
Figure 4:
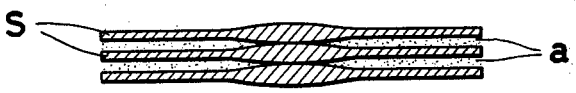
FIG. 4 is a partial cross section of a sheet roll illustrating the optimum condition between adjoining layers of sheet.

Typical adverse effects which occur when the sheet winding is carried out without making any compensation for this error are illustrated in FIGS. 2 and 3. Strictly speaking, all sheet materials have some degree of surface irregularity. Consequently, when a sheet is wound repeatedly one layer on top of another, the outer contour of the finished roll of sheet shows bulges and dents. When the sheet is unwound from the roll, the portions of the sheet in the buldged part of the roll may be found to be permanently stretched. This is particularly true, of course, for a sheet material of low elasticity. It is, therefore, ideal to have the sheet wound as loosely as permissible. If it is wound too loosely, however, the air table phenomenon may arise so that the resulting roll may suffer from winding squeeze and be easily deformed when stacked for storage or transport. It is therefore best for the sheet to be wound in such a way that a layer of air a is allowed to intervene between the adjoining layers where the thickness of the layer is smaller than a neighboring portion of the layer as illustrated in FIG. 4. Such layers of air will not be formed unless the contact pressure between the sheet roll and the touch roller is maintained constantly at the optimum level. In other words, the sheet material of the finished roll of sheet will not retain the properties it had prior to winding unless the difference between the real radius and the apparent radius of the sheet roll is taken into account.

Figure 5:
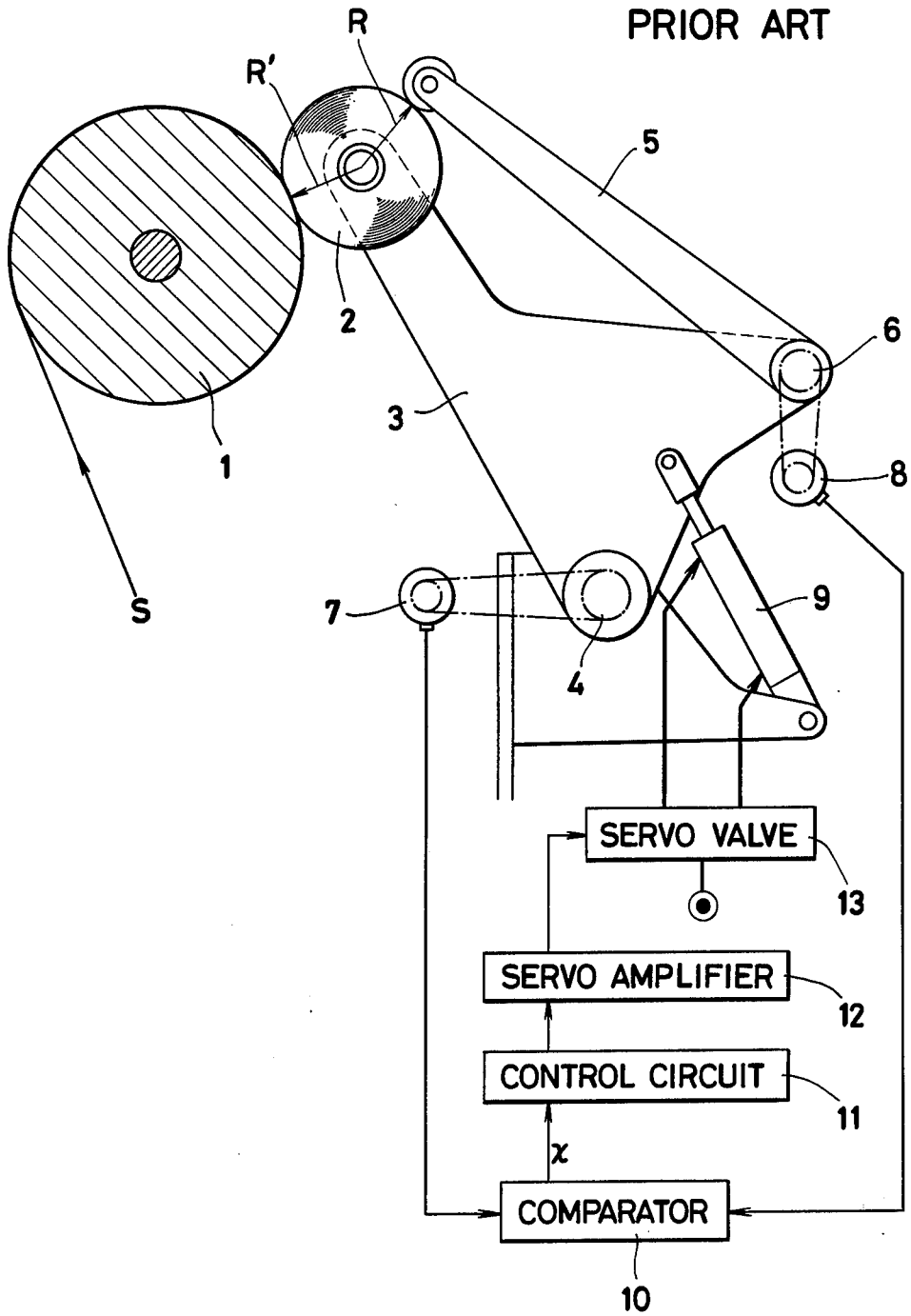
Fig. 5 PRIOR ART
FIG. 5 is an explanatory diagram illustrating a part of the conventional sheet winder provided with means capable of comparatively accurately measuring the amount of sheet wound on the sheet roll.

The inventor has already perfected a sheet winder of the construction shown in FIG. 5 which overcomes the problem concerning the occurrence of the error (R-R′). In this sheet winder, changes in the radius of the sheet roll 2 are detected as changes in the relative angle between a radius measuring arm 5 held in light contact with the outer surface of the sheet roll and the rocking arm 3 of the sheet roll. The radius measuring arm 5 is made so light as not to create an appreciable depression in the outer surface of the sheet roll. The angular change of the shaft 6 of the radius measuring arm 5 is applied to a potentiometer 8 and converted into an electric signal. The detected angular change also includes angular change of the rocking arm 3 due to the increase in the radius of the sheet roll. The angular change in the shaft 4 of the rocking arm is detected by another potentiometer 7. In a comparator 10, the electric signal thus obtained is compared with the electric signal obtained from the potentiometer 8 to determine the difference (equivalent to the difference in the relative angle between the radius measuring arm and the rocking arm). The signal x representing this difference and issuing from the comparator 10 is a function of the total weight (or the amount of sheet wound on the roll). This signal x is transmitted to the control circuit 11 which is programmed to calculate the optimum contact pressure from the valve x. A signal corresponding to the optimum contact pressure is forwarded to a servo valve 13 via a servo amplifier 12. The servo valve 13 controls the motion of the hydraulic actuator 9 to produce the optimum contact pressure. This method eliminates the error which would otherwise be introduced into the contact pressure control system by the depression in the sheet roll and, as the result, enables the sheet winding to be carried out in the most favorable condition with the optimum contact pressure.

Application of the method described above, however, requires the construction of sheet winder especially designed to carry out the method and, furthermore, the control circuit is programmed to determine the optimum contact pressure for a particular type of sheet material and must be re-programmed when a different type of material is to be wound. Thus, although this method is capable of automatically controlling the contact pressure upon the touch roller to the optimum level in accordance with the true radius of the sheet roll, it cannot, without re-programming, be applied to a variety of kinds of sheet material.

The inventor has now developed a method for the control of optimum contact pressure which is simple to operate and applicable to all sheet materials. In the development of this method, the inventor collected a large volume of data on the optimum winding conditions for a wide variety of sheet materials and using this data invented a method for determining the optimum contact pressure for any sheet material. The nature of his study will be more easily understood from the following example.

Reference is first made to the data on the winding conditions for a sheet of rather thick paper, 1200mm in width and 0.2mm in thickness, which does not have a slippery surface. For this sheet of paper to be wound into a roll of the best quality, it is desirable to fix the contact pressure $F_o$ at a relatively high level in the beginning of the winding operation and, in consideration of the fact that the sheet does not readily slip or elongate, to increase the contact pressure gradually in the course of the winding operation. Graphically, this is represented by the straight line m in FIG. 6.

Reference is now made to another set of data which concern the winding conditions for a sheet of plastic film, 1000mm in width and 20μm in thickness, which has a rather slippery surface. For this sheet it is desirable to fix the contact pressure $F_o$ at a comparatively low level in the beginning of the winding operation and, in consideration of fact that the sheet easily slips and elongates, to lower the contact pressure gradually and, after the amount of sheet wound on the roll has reached a certain level, to gradually reduce the rate of decrease of the contact pressure. Graphically, this condition is represented by the curve n in FIG. 6.

From this it is clear that each type of sheet material has its own optimum contact pressure conditions for obtaining the most nearly ideal finished roll. When represented graphically as in FIG. 6, the contact pressure conditions for sheet materials having slippery surfaces, described downwardly inclined lines and those not having slippery surfaces described upwardly inclined lines. Those for sheet materials having greater tendency to elongate have greater curvatures while those for sheet materials which do not elongate are straight. The rate of increase or decrease (as the case may be) in the contact pressure decreases as the amount of sheet wound on the roll increases. The characteristic line representing the optimum contact pressure in the course of winding for any kind of sheet material can be generated and graphically represented in the manner of FIG. 6 from the two fundamental sets of characteristics shown in FIGS. 7(*a*) and 7(*b*). Analysis of all the data obtained in the inventor's experiments shows that the characteristic pressure curve for all sheet materials can be obtained from the following equation.

$$F = F_o\{1 + \gamma f(x)^{\theta}\} \quad (1)$$

wherein, $F_o$ stands for the contact pressure at the beginning of the winding operation, $\gamma$ and $\theta$ for the values determined with respect to the properties of the particular sheet which determine the curve pattern of the change in optimum contact pressure with increasing volume of wound sheet, and x for the amount of sheet wound on the roll.

It is plain from the foregoing that in the function $\gamma f(x)^{\theta}$, the constant $\theta$ determines the inclination of the straight lines in the graph of FIG. 7(*a*) and the constant $\gamma$ determines the curvature of the curves in the graph of FIG. 7(*b*). The characteristic curve (defined to include the case of a straight line) for any sheet material can be represented in the manner shown in the graph of FIG. 6 by fixing these constants and selecting the initial contact pressure $F_o$ at the beginning of the winding operation.

In the case of the curve for comparatively thick paper represented by line m in the graph of FIG. 6, for example, since the constant $\gamma$ is 0.2 (the straight line for $\gamma>0$ in FIG. 7(*a*)) and the constant $\theta$ is 1 (the straight line for $\theta=1$ in FIG. 7(*b*)), the sheet is wound with an initial contact pressure of 30kg and a final contact pressure of 36kg. In the case of plastic film having a slippery surface and a tendency to elongate represented by the curve n in the graph of FIG. 6, since the constant $\gamma$ is $-0.2$ (the straight line for $\gamma<0$ in FIG. 7(*a*)) and the constant $\theta$ is 0.8 (the concave curve for $\theta<1$ in FIG. 7(*b*)), the sheet is wound with the initial contact pressure of 13kg and the final contact pressure of 10.4kg.

Figure 8:
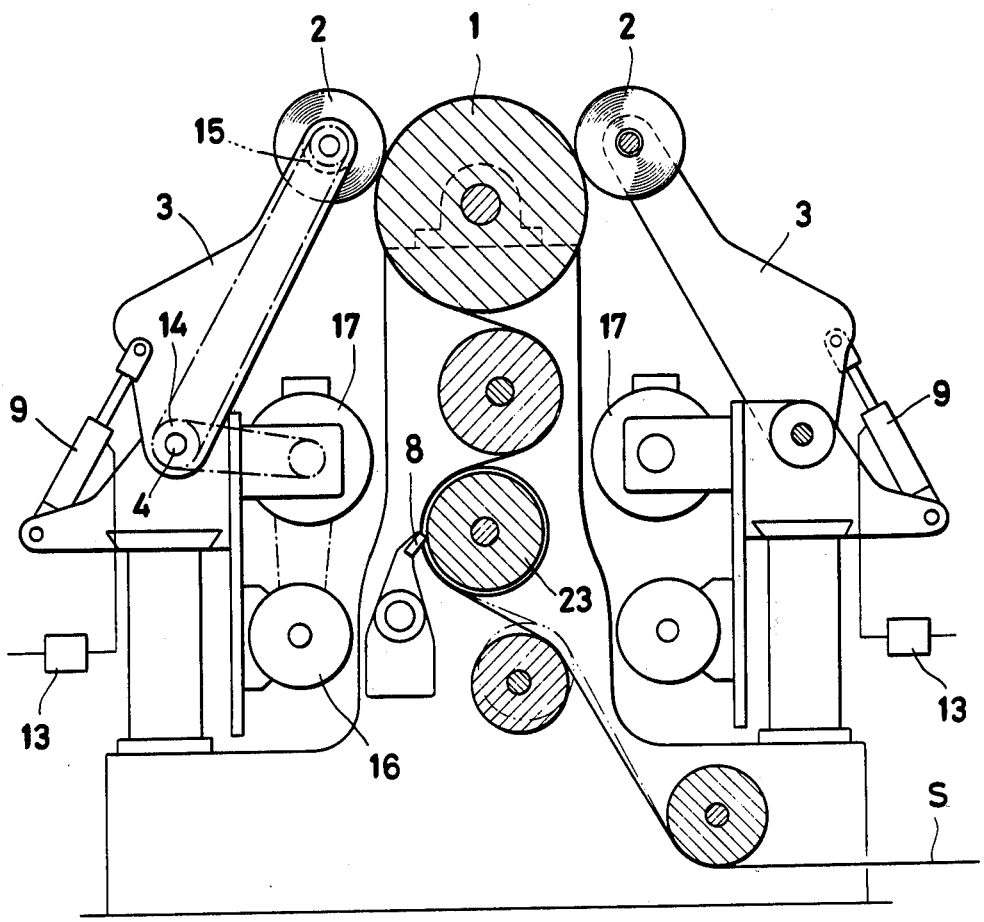
FIG. 8 represents a sheet winder for practicing the method of contact pressure control according to the present invention.
Figure 9:
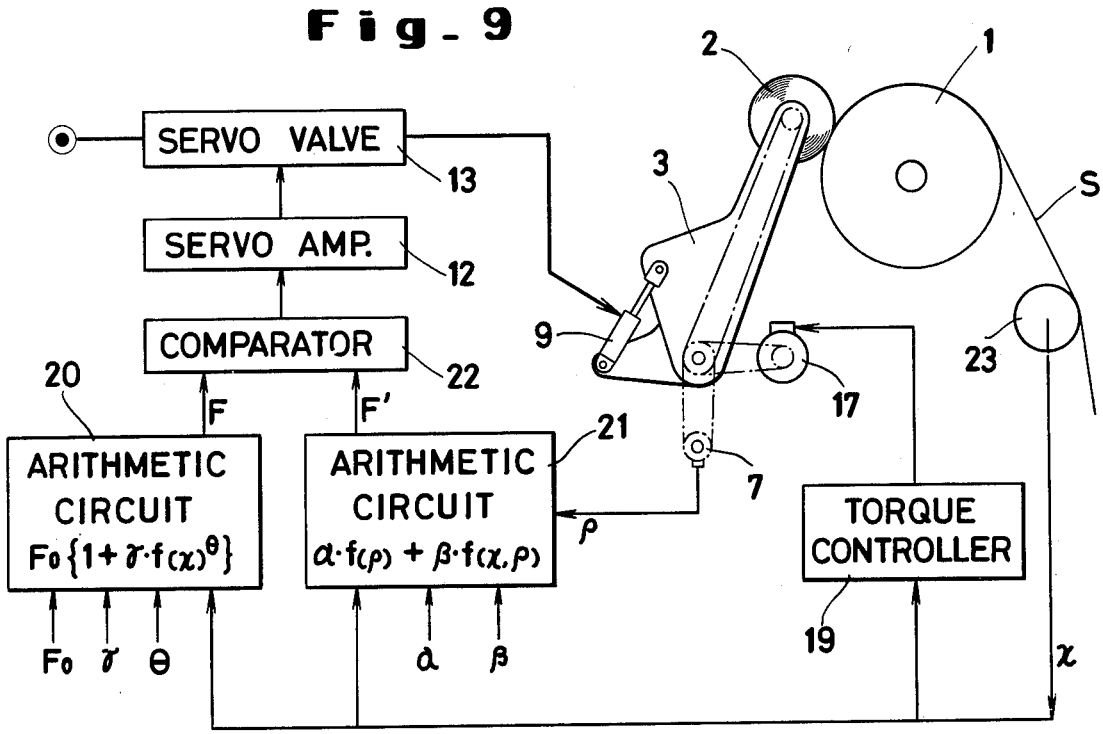
FIG. 9 is a block diagram of one preferred embodiment of the control circuit to be used for working the method of contact pressure control according to the present invention.

The required control of the optimum contact pressure can be accomplished by providing in the control circuit 11 of FIG. 5 with circuits for performing arithmetic operations in accordance with the equation of Formula (1) when supplied with the constants $\gamma$, $\theta$ and $F_o$ for the sheet material to be wound. A typical sheet winder which makes use of this operating principle is illustrated in FIG. 8. This sheet winder is provided with a counter roller 23 which meters the amount of sheet passing thereover and produces a signal x representing this amount. Therefore, the sheet winder does not require the radius measuring arm 5 shown in FIG. 5 and may be considered to be merely one type of conventional sheet winder adapted to be operated in accordance with the foregoing principle. The parts of the sheet winder of FIG. 8 corresponding to those of the sheet winder of FIG. 5 are given the same reference numerals. The sheet winder has two sheet winding units of identical construction disposed one on either side of a touch roller. The arithmetic processing in accordance with Formula (1) is performed by a circuit 20 shown in FIG. 9.

For the sheet winding method described above to be carried out effectively it is necessary to continuously determine the contact pressure between the sheet roll and the touch roller which would exist in the absence of any adjustment of the contact pressure since it is only through a comparison of this uncompensated contact pressure with the desired contact pressure determined in accordance with Formula (1) that the actual contact pressure can be adjusted to the optimum value. This uncompensated contact pressure is determined by an arithmetic circuit 21.

Figure 10:
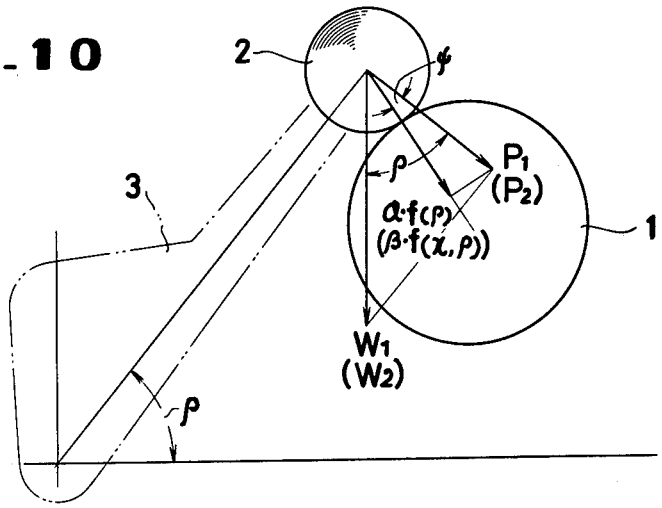
FIG. 10 is a diagram for the explanation of the uncompensated contact pressure involved in the working of this invention.

Two factors have direct bearing upon the uncompensated contact pressure on the touch roller. One is the weight of the sheet roll and the other is the free end weight of the rocking arm 3. The uncompensated contact pressure F′ exerted by these factors upon the touch roller can be expressed by the following equation.

$$F' = \alpha \cdot f(\rho) + \beta \cdot f(\chi, \rho) \qquad (2)$$

wherein, the term $\alpha \cdot f(\rho)$ represents the portion of the uncompensated contact pressure exerted by the free end weight of the rocking arm 3 and the term $\beta \cdot f(\chi,\rho)$ the portion of the uncompensated contact pressure exerted by the weight of the sheet roll. The relationship can easily be explained with reference to FIG. 10. If the rocking arm 3 has a weight $W_1$ at its free end, it generates a component $P_1$ in the direction tangential to the locus of rotation described by its free end. The component which this component $P_1$ produces in the direction of the axis of the touch roller is the uncompensated contact pressure $\alpha \cdot f(\rho)$ of the rocking arm. This value is calculated as $W_1 \cdot \cos\rho \cdot \cos\psi$ in the diagram. The free end weight $W_1$ of the rocking arm is a constant which is determined by multiplying the weight of the rocking arm by the value found by dividing the distance of the center of gravity from the fulcrum by the entire length of the rocking arm.

The uncompensated contact pressure $\beta \cdot f(\chi,\rho)$ due to the weight $W_2$ of the sheet roll 2 can be determined in the same manner as described above and the weight $W_2$ can be found by multiplying the thickness, width and length of the sheet by the unit weight of the sheet material. The length of the sheet wound is detected by means of a counter roller 23, with the result that the problem of the error due to the depression caused in the surface of the sheet roll is not raised. In the compensated contact pressure exerted by the rocking arm, the product $\cos\rho \cdot \cos\psi$ which is variable with the angle of elevation of the arm 3 and determines the component of the weight $W_1$ and $W_2$ acting in the direction of the axis of the touch roller. The values $\cos\rho \cdot \cos\psi \cdot W_1$ and $\cos\rho \cdot \cos\psi \cdot W_2$ are determined by the arithmetic circuit 21 of FIG. 9.

The electric signal $\rho$ which is produced by potentiometer 7 on the basis of the change in the angle of elevation of the rocking arm 3 is forwarded to the arithmetic circuit 21 programmed to perform arithmetic operations in accordance with Formula (2) and the electric signal x which is produced by the counter roller 23 is forwarded to the arithmetic circuits 20 and 21. On receipt of the electric signal, the arithmetic circuit 20 determines the optimum contact pressure F proper to the amount of sheet wound on the roll on the basis of the initial contact pressure $F_0$ set at the beginning of the winding operation and the values $\gamma$ and $\theta$ determined for the properties of the sheet material which are fed to the circuit in advance. The optimum contact pressure F thus obtained from the arithmetic circuit 20 is compared with the uncompensated contact pressure F′ from the arithmetic circuit 21 in the comparator 22. The difference found is the required compensation to produce optimum contact pressure and a signal representing this difference is forwarded from the comparator through the servo amplifier 12 to the servo valve 13 to control the operation of the hydraulic actuator 9.

Since the present invention adopts a method of precluding the otherwise possible error due to the apparent volume of sheet wound in the roll and relies on effective analysis of the specific properties the sheet material exhibited in the course of the winding operation, it permits automatic control of the optimum sheet winding of any given sheet material, which all the conventional methods have failed to accomplish.

A powder clutch 17 shown in FIG. 8 is actuated by the rotation of a motor 16 to impart rotation through the medium of the pulleys 14 and 15 to the sheet roll 2 so that the sheet roll 2 will take up the sheet S. For the purpose of maintaining the torque of rotation constantly optimized for the increasing radius of the sheet roll, the torque of the powder clutch 17 is controlled by a torque controller 19 on the basis of the signal x representing the amount of sheet wound on the roll. The counter roller 23 is provided with a plurality of slitters 8 which cut the sheet in motion into as many strips in the longitudinal direction. All these units are also found in the conventional sheet winders. Thus, the method of the present invention for the automatic control of the optimum contact pressure on the touch roller has an outstanding advantage in that it can easily be applied to virtually all sheet winders of the kind using a touch roller. Capable of establishing the optimum characteristics of contact pressure for the winding of a sheet of any given material, the method of this invention provides advantageous winding of the sheet without impairing the properties inherently possessed by the sheet material in use. Further capable of analyzing these characteristics of contact pressure into simple factors which are programmed into the electronic circuit, the present method enables the winding operation and the attendant setting work to be carried out with the ease and reliability not attained heretofore. As the result, the operation of this method affords rolled sheets of high quality.

What is claimed is:

1. In a sheet winder of the type wherein the sheet roll being wound is supported at the free end of a rocking arm and held in contact with a touch roller at a constant pressure determined by the difference between the component of the combined weight of the rocking arm and the sheet roll acting in the direction of the axis of the touch roller and a component of force acting in the opposite direction applied to the rocking arm by a servo mechanism, a method for the control of the contact pressure between the sheet roll and the touch roller, which method comprises:

programming a first arithmetic circuit to perform arithmetic operations in accordance with the formula:

$$F = F_o\{1 + \gamma f(x)^{\theta}\}$$

wherein F is the desired contact pressure, $F_o$ is the contact pressure at the beginning of the winding operation, x is a variable whose value changes in proportion to the increasing weight of the sheet roll $\gamma$ and $\theta$ are numerical values predetermined empirically for the sheet material to be wound, feeding the value of $F_o$, the values of $\gamma$ and $\theta$ determined for the sheet to be wound and the value of x to the first arithmetic circuit to obtain the value F, feeding the value of x, the value of $\rho$ representing the angle of inclination of the rocking arm and values representing the unit weight of the sheet material, the weight of the rocking arm and its geometric relationship to the touch roll to a second arithmetic circuit programmed to calculate the uncompensated contact pressure between the sheet roll and the touch roll and obtaining the uncompensated contact pressure as the value F', feeding the values of F and F' to a comparator circuit to obtain a signal corresponding to the difference therebetween, and feeding the difference signal to the servo mechanism to control the force it exerts on the rocking arm, whereby the contact pressure between the sheet roll and the touch roll is adjusted to the desired contact pressure.

2. In a sheet winder of the type wherein the sheet roll being wound is supported at the free end of a rocking arm and held in contact with a touch roller at a contact pressure determined by the difference between the component of the combined weight of the rocking arm and the sheet roll acting in the direction of the axis of the touch roller and a component of force acting in the opposite direction applied to the rocking arm by a servo mechanism, a device for the control of the contact pressure between the sheet roll and the touch roller, which device comprises:

a first arithmetic circuit programmed to calculate the optimum contact pressure over the whole winding operation from various properties empirically determined for the particular material of the sheet being wound on the sheet roll, a second arithmetic circuit programmed to calculate the uncompensated contact pressure which the weights of the sheet roll and the rocking arm would exert upon the touch roll if no adjustment of contact pressure were performed, and a comparator adapted to compare the optimum contact pressure and the uncompensated contact pressure received from the respective arithmetic circuits and produce a signal corresponding to the difference between the optimum contact pressure and the uncompensated contact pressure, whereby the servo mechanism is controlled by the difference signal to adjust the contact pressure to the optimum contact pressure.

* * * * *